US005182998A

United States Patent [19]

Iwase

[11] Patent Number: 5,182,998

[45] Date of Patent: Feb. 2, 1993

[54] APPARATUS FOR MOUNTING AND REMOVING THE SUPPORTING FRAME OF A QUILT OR THE LIKE IN SEWING MACHINES

[75] Inventor: Yukio Iwase, Utsunomiya, Japan

[73] Assignee: Prince Corporation, Tokyo, Japan

[21] Appl. No.: 779,407

[22] Filed: Oct. 17, 1991

[30] Foreign Application Priority Data

Oct. 23, 1990 [JP] Japan ..... 2-284691

[51] Int. Cl.[5] ..... D05B 11/00

[52] U.S. Cl. ..... 112/117

[58] Field of Search ..... 112/117, 118, 119

[56] References Cited

U.S. PATENT DOCUMENTS

| | | | |
|---|---|---|---|
| 3,070,049 | 12/1962 | Kalning | 112/117 |
| 3,124,256 | 3/1964 | Schwarzberger | 112/118 X |
| 3,158,116 | 11/1964 | Kalning | 112/119 |
| 3,180,293 | 4/1965 | Cash | 112/118 |
| 3,382,825 | 5/1968 | Cash | 112/117 |
| 3,442,234 | 5/1969 | Cash | 112/118 |
| 4,042,120 | 8/1977 | Frigo . | |

FOREIGN PATENT DOCUMENTS 541662 1/1932 Fed. Rep. of Germany .

*Primary Examiner*—Peter Nerbun
*Assistant Examiner*—Paul C. Lewis
*Attorney, Agent, or Firm*—Kane, Dalsimer, Sullivan, Kurucz, Levy, Eisele and Richard

[57] ABSTRACT

A pair of left and right guide rails and a pair of left and right supporting rails which support the supporting frame of a quilt or the like, are provided with a pivot on one side of the sewing machine to permit circular movement. These rails are parallel to each other. A moving member is provided along the guide rails, and this moving member is moved by a moving apparatus. An anchoring member is also provided to anchor the member to the supporting frame. Furthermore, an apparatus for moving up and down, which allows the guide rails and the supporting rails to move in a circular manner using the pivot as a fulcrum, is provided to anchor the anchoring members of the supporting frame or to release the anchoring.

2 Claims, 5 Drawing Sheets

APPARATUS FOR MOUNTING AND REMOVING THE SUPPORTING FRAME OF A QUILT OR THE LIKE IN SEWING MACHINES

BACKGROUND OF THE INVENTION

The present Invention relates to an apparatus for mounting and removing the supporting frame of a quilt or the like in sewing machines, in which a supporting frame to support a quilt or the like, which will be sewn by a sewing machine, is sent to the sewing machine and placed in a predetermined position relative to the sewing machine, and in which the quilt or the like, which has been sewn by the sewing machine, is removed with the support frame from the sewing machine.

In a conventional machine for sewing quilts, when the supporting frame of a quilt is mounted and removed, a preparatory worktable is set, with two mounting parts at the up and down steps to mount the supporting frame of the quilt, on the side of the sewing machine. While one quilt supported by the supporting frame is bound by the sewing machine, an operator should support the next quilt by binding it with the other supporting frame on the lower mounting part of the worktable, and mounting it on the upper mounting part of the worktable. When the former quilt has been bound by the sewing machine, the operator should move the quilt with the supporting frame from the sewing machine onto the lower mounting part of the worktable and pick out the next quilt with the supporting frame placed on the upper mounting part of the above-mentioned worktable for mounting onto a predetermined position of the sewing machine.

However, there has been a problem in that it requires much effort and time to perform this operation in this way because two operators must stand, one on the right side and one on the left side, and use their hands to handle the supporting frame and mount it on the sewing machine, or remove it from the sewing machine.

SUMMARY OF THE INVENTION

An object of the present invention is to provide an apparatus for mounting and removing the supporting frame of a quilt or the like on sewing machines, in which a supporting frame can be rapidly and easily mounted and removed without the manual labor of operators.

The construction of the present invention comprises:

a pair of left and right guide rails, of which one end can pivot because a pivot has been provided on one side of the sewing machine; these guide rails are circularly movable and have been provided with a pivot as a fulcrum; they are also parallel to each other;

a pair of left and right support rails, of which one end is pivoted; these supporting rails are circularly movable and have been provided with a pivot as a fulcrum and are provided in parallel with the guide rails, which slide and move to support the supporting frame of a quilt or the like;

an apparatus for moving up and down which makes the guide rails and the supporting rails move circularly with the pivot as a fulcrum, and which makes these guide rails and the other end of the supporting rails move up and down;

a moving apparatus which moves the moving member along the pair guide rails; and anchoring members which are provided to anchor the moving member to the supporting frame.

The above-described construction ensures that the supporting frame supporting a quilt or the like can be rapidly and easily mounted on and removed from a sewing machine without the manual labor of operators.

DETAILED DESCRIPTION OF THE PREFERRED EMBODIMENTS

Figure 1:
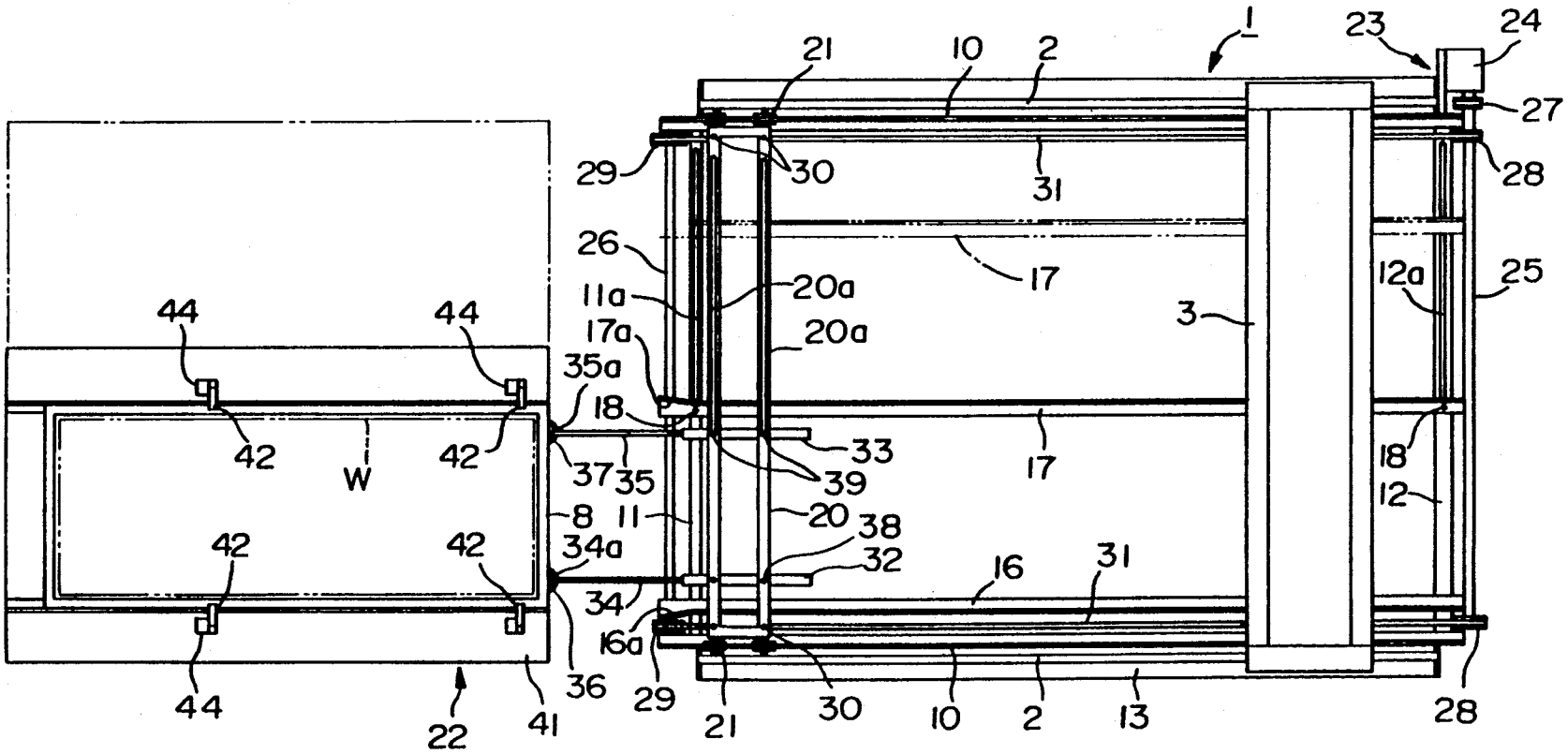
FIG. 1 is a plan of an apparatus for mounting and removing a supporting frame, which is provided with a sewing machine to bind a quilt according to the present invention.

The accompanying drawings show the embodiments of the present invention. Reference number 1, in the figures, represents a sewing machine used to bind a quilt. The sewing machine 1 is provided with a frame 3 on a pair of left and right Y axis rails 2 and 2, and is provided with a sewing machine head 5 in the upper X axis rails 4 and 4, of the frame 3, and is provided with an metal sewing base portion 7 on the lower X axis rails 6 and 6. The Y rails 2 and 2 are built in the Y axis direction (in the left and right directions in FIGS. 1 and 2), while the X axis rails 4 and 4 and 6 and 6 are built in the X axis direction (in the vertical direction on the plane in FIG. 2), which is perpendicular to the Y axis rails 2 and 2. The frame 3 is moved by a driving device on the Y axis (not shown in the figures) along the Y axis rails 2 and 2. The sewing machine head 5 and the metal sewing base portion 7 are moved in synchronical by a driving device on the X axis (not shown in the figures) along the X axis rails 4 and 4, and 6 and 6, respectively. The above-mentioned driving devices on the Y axis and X axis, and the sewing machine head 5 and the metal sewing base portion 7 are controlled during operation by a control unit such as a computer (not shown in the figures) and the quilt W supported by a supporting frame 8 is bound in the desired pattern. The basic construction of a sewing machine 1 for binding a quilt is generally known (disclosed in, for example, Japanese Examined Utility Model Publication No. 61-32626).

Figure 2:
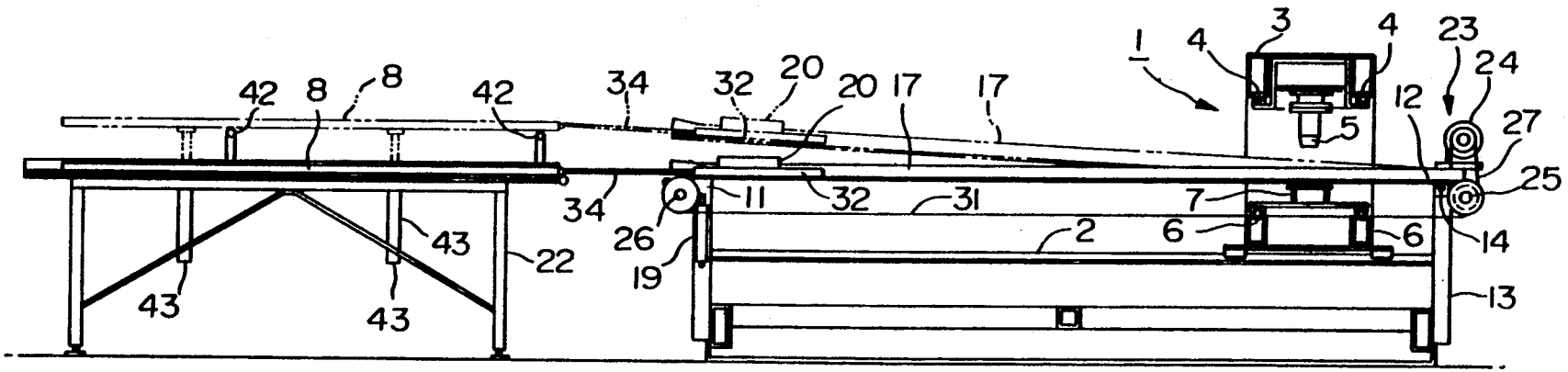
FIG. 2 is a cross-sectional view of an apparatus for mounting and removing the supporting frame in FIG. 1.
Figure 2A:
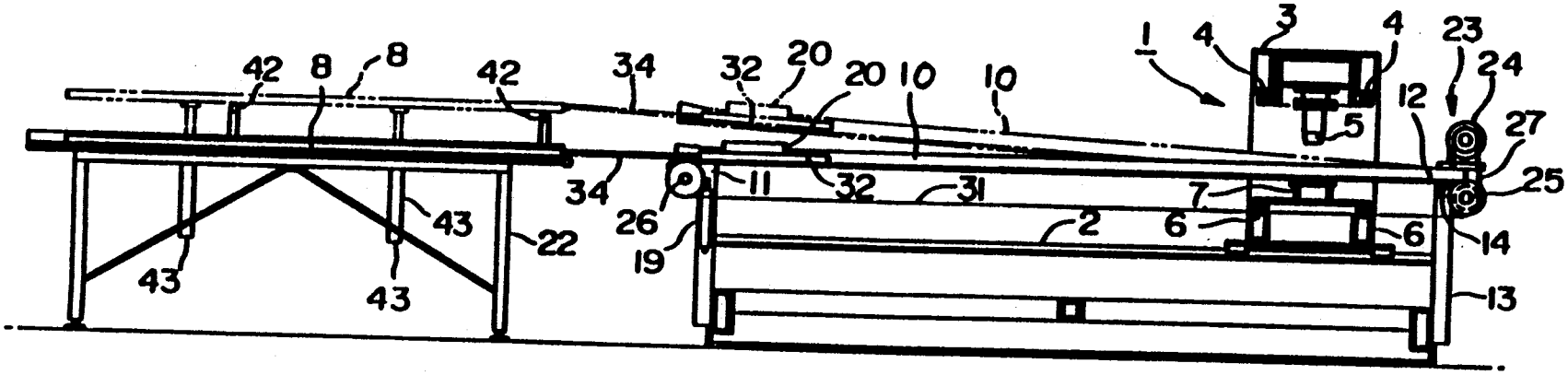
Figure 3:
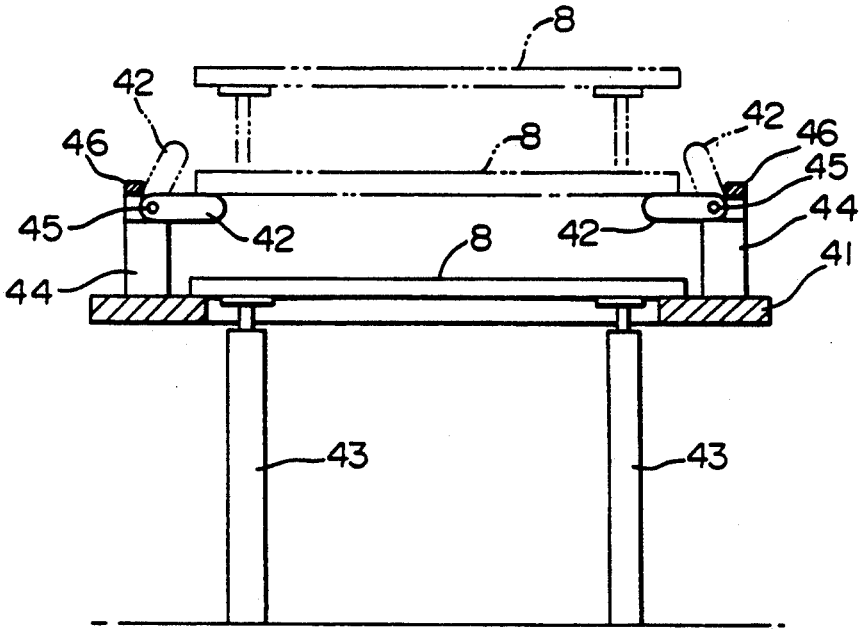
FIG. 3 is a sectional view showing an essential portion of the worktable.
Figure 4:
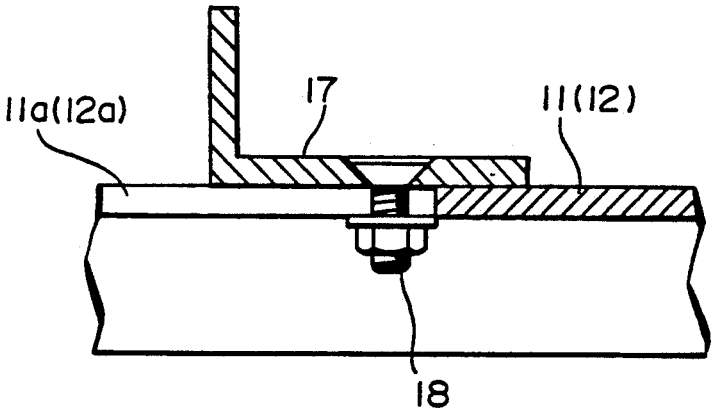
FIG. 4 is a sectional view showing an example of the provision of a supporting rail with a ledge.
Figure 5:
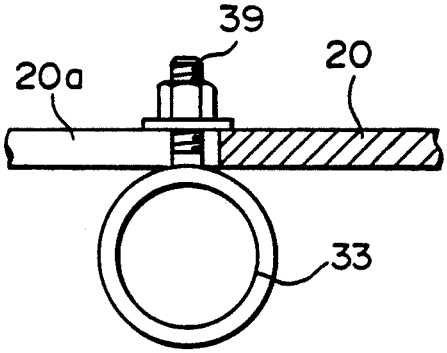
FIG. 5 is a sectional view showing an example of the provision of an auxiliary cylinder with a moving member.
Figure 6:
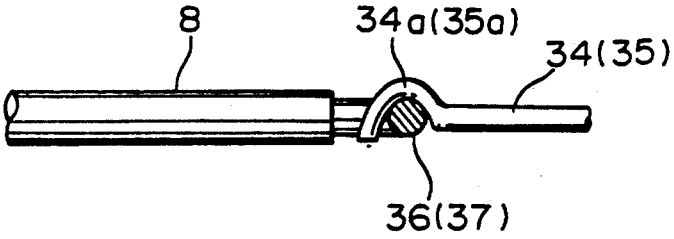
FIG. 6 is a side view showing the connecting conditions of the anchoring member with an anchor ring.

Furthermore, reference number 10 represents a guide rail. A pair of guide rails 10 are provided on the right and left sides, and a pair of former and latter ledges 11 and 12 are provided with the guide rails and form a square. The ledge 11 is mounted by a pivot 14 on a base table 13 on which the Y axis rails 2 and 2 have been built. The guide rails 10 and 10 are in parallel with the Y axis rails 2 and 2 in a plane view. The ledges 11 and 12 are provided with a pair of right and left supporting rails 16 and 17 in parallel with the guide rails 10 and 10. The supporting rails 16 and 17 support the supporting frame 8 which slides. One supporting rail 16 can be fixed at a predetermined position on the ledges 11 and 12 by welding, bolts and the like, while another supporting rail 17 can be fixed at any position by penetrating a bolt 18 into the long holes 11*a* and 12*a* which are provided on the ledges 11 and 12. It is possible with this construction to adjust the interval between the supporting rails 16 and 17 to the width of the supporting frame 8. A pair of right and left cylinders for moving up and down 19 and 19 (only one apparatus is shown in FIG. 2), are provided between a base table 13 and the ledge 11 to move the guide rails 10 and 10 and the supporting rails 16 and 17 up and down by using the pivot 14 as a fulcrum.

In the guide rails 10 and 10 a moving member 20 constructed like a pushcart, with wheels 21 that are mounted on the guide rails 10 and 10, is circularly movable and provided along the guide rails 10 and 10. The moving member 20 pulls the supporting frame 8 off the worktable 22 up to the supporting rails 16 and 17 to allow the supporting frame 8 to slide into the predetermined position, and pushes the supporting frame 8 on the supporting rails 16 and 17 onto the worktable 22, and is operated by a moving apparatus 23. The moving apparatus 23 comprises: a driving motor 24, an axis of rotation 25 which pivots in parallel with the ledge 12 in the back of the ledge 12 (on the right side of FIGS. 1 and 2), an axis of rotation 26 which pivots in parallel with the ledge 11 in front of the ledge 11, a transmission mechanism 27 which transmits a rotation of the driving motor 24 to the axis of rotation 25, timing belts 31 and 31 which are wound to timing pulleys 28 and 29, which are provided on the axes of rotation 25 and 26, and are fixed on the moving member 20 with rivets 30. Furthermore, the axis of rotation 25 is rotated by the driving motor 24 so that the moving member 20 can be move along the guide rails 10 and 10 through the timing belts 31 and 31.

Auxiliary cylinders 32 and 33 are also provided with the moving member 20. Each cylinder 32 and 33 consists of piston rods 34 and 35 with tops that have anchoring members 34*a* and 35*a* formed of hooks. The anchoring members 34*a* and 35*a* are anchored to the anchor rings 36 and 37, which are provided with the supporting frame 8 so that the moving member can be connected to the supporting frame 8. One auxiliary cylinder 32 can be fixed at the predetermined position of the moving member 20 with a bolt 38; another auxiliary cylinder 33 can be fixed at any position along the moving member 20 by inserting a bolt 39 into the long hole 20*a* that has been formed in the moving member 20. Therefore, it is possible to adjust the width to locate the auxiliary cylinders 32 and 33 and to locate the anchor rings 36 and 37.

The worktable 22 consists of one work plate 41, several supporting bars 42 (four in the figure), and several pushing-up cylinders 43 (four in the figure). The supporting bars 42 pivot on small axes 45 on two mounting members 44 which are vertically provided on the right and left sides of the work plate 41, and are capable of moving upwards from the horizontal positions. Moreover, the supporting bars 42 make up the supporting frame 8, which is raised from the work plate 41 by the push-up cylinders 43, rises and passes, then comes down horizontally to support the supporting frame 8 after the supporting frame 8 has been passed. The supporting bars 42, in the figure, are constructed to come down by the weight thereof, but can be constructed to come down horizontally with springs or the like. The supporting bars 42 are protected from any excessive movement by stoppers 46 which are fixed on the mounting member 44. The front end portions 16*a* and 17*a* of the supporting rails 16 and 17 are inclined in the form of an outward opening to continue receiving the supporting frame 8.

Next, the mode of operation of an apparatus for mounting and removing the supporting frame of a quilt or the like from a sewing machine, which is conducted in the above-mentioned way, according to the present invention is explained.

To support a quilt W on the supporting from 8 as in the conventional way, the supporting frame 8 is mounted onto the work plate 41 of the worktable 22. When the quilt W is supported on the supporting frame 8, the push-up cylinder 43 is expanded to raise the supporting frame 8. After the supporting frame 8 rises, the supporting bars 42, which are pushed by the supporting frame 8, move upwards and make the supporting frame 8 pass at the upper level, thereafter coming down horizontally. Since the push-up cylinders 43 are immediately reduced after expanding to raise the supporting frame 8, the supporting frame 8 lowers on the supporting bars 42 which come down horizontally and is supported by the supporting bars 42.

In case the supporting frame 8 supported on the supporting bars 42 is mounted on the sewing machine 1, the auxiliary cylinders 32 and 33 are reduced and the moving apparatus 23 is operated to move the moving member 20 forward on the worktable 22. Furthermore, a cylinder for moving up and down 19 is expanded to raise the guide rails 10 and 10 and the supporting rails 16 and 17 by using the pivot 14 as a fulcrum. After the auxiliary cylinders 32 and 33 are expanded to move the anchoring members 34*a* and 35*a* directly above the anchor rings 36 and 37, the cylinder for moving up and down 19 is slightly reduced to anchor the according members 34*a* and 35*a* to the anchor rings 36 and 37, and to connect the moving member 20 with the supporting frame 8.

Finally, the auxiliary cylinders 32 and 33 are retracted and the moving apparatus 23 is moved backwards with the moving member 20 so that the supporting frame 8 is pulled from the supporting bars 42 to the supporting rails 16 and 17 and slides on the supporting rails 16 and 17. Moreover, the cylinder for moving up and down 19 is reduced to lower the guide rails 10 and 10 and the supporting rails 16 and 17 by using the pivot 14 as a fulcrum, and to mount the supporting frame 8 into position in which the quilt can be bound.

After the above operation, as is generally known, the sewing machine 1 can be operated to bind a quilt W supported on the supporting frame 8.

In addition, to remove the quilt W, which has been bound, from the sewing machine 1, the moving apparatus 23 is operated to move the moving member 20 forward from the worktable 22 and the auxiliary cylinders 32 and 33 are expanded to push and move the quilt W with the supporting frame 8 from the supporting rails 16 and 17 to the work plate 41. Thereafter, the cylinder for moving up and down 19 is slightly expanded to raise the supporting frame 16, 17 or the like, the anchoring members 34*a* and 35*a* are released from the anchor rings 36 and 37 to reduce the auxiliary cylinders 32 and 33. While one quilt W is sewn by a sewing machine, the next quilt W is supported, by an operator, with the other supporting frame 8 on the work plate 41, and is mounted on the supporting bars 42. Therefore, if the binding operation is continued, it becomes necessary to once again expand the cylinder for moving up and down 19 and mount the supporting frame 8 of the supporting bars 42 in the position where binding is possible in the described way.

The embodiments, except for the above-mentioned, and technical matters will be described below.

(1) In the figure, the supporting rails 16 and 17 are constructed to be moved up and down with the guide rails 10 and 10 by the same cylinder for moving up and down 19 using the same pivot 14 as a fulcrum. However, they can be constructed to be moved up and down by the same or a different cylinder by using the other pivot as a fulcrum.

(2) When the supporting rails 16 and 17, and the guide rails 10 and 10 are mounted by different pivots 14 it is preferable for the axes of these pivots to correspond with each other; however, it is possible to operate the apparatus even if the axes of the pivot have shifted to some extent.

(3) The apparatus for mounting and removing according to the present invention, can be automatically controlled by the control unit and can be manually controlled by an operator.

(4) As shown in the embodiment, the supporting rail 17 and the auxiliary 33 are mounted and adjusted with bolts 18 and 39. They can be adjusted to the left and right (in the X axis direction) by a moving means such as a screw, a wire rope, a cylinder or the like. Also, it is preferable for the upper mounting member 44 in FIG. 1, to be adjustable and move to the left and right as in the supporting rail 17 and the auxiliary cylinder 33.

(5) As the case may be, the supporting frame 8 of the work plate 41 can be pulled to the supporting rails 16 and 17 to mount in a binding position, and a quilt W which has been bound can be pushed onto the supporting bars 42.

(6) As shown in the embodiment, an apparatus for mounting and removing is provided with the sewing machine- to bind a quilt, and it can also be provided with the other kinds of sewing machines such as a sewing machines for embroidery.

(7) The anchoring members 34*a* and 35*a* can be directly provided with a moving member 20 without the auxiliary cylinders 32 and 33.

(8) It is possible to use a magnet or a hook for the anchoring members 34*a* and 35*a*.

(9) As shown in the embodiment, in the sewing machine 1, the sewing machine head 5 and the metal sewing base portion 7 are synchronized with each other, both longitudinally and transversely, and are moved to bind a quilt W fixed to a predetermined position. The supporting frame 8 which supports a quilt W, can be mounted on a movable table so that the quilt W can be moved between the sewing machine head 5 and the metal sewing base portion 7. The apparatus for mounting and removing can be provided with the sewing machine.

What is claimed is:

1. An apparatus for mounting and removing a supporting frame of a quilt in sewing machines, comprising:

a pair of left and right guide rails wherein one end pivots on one side of a sewing machine, the guide rails provided as a fulcrum, allowing the guide rails to be moved in a circular fashion, and are arranged in parallel with each other;

a pair of left and right supporting rails wherein one end pivots with the pair of left and right guide rails, the left and right supporting rails pivoting as a fulcrum to permit circular movement, and are arranged in parallel with the guide rails, that slide and support the supporting frame of the quilt;

an apparatus for moving up and down to produce circular motion of the guide rails which pivot as a fulcrum, and which urges these guide rails and a second end of the supporting rail to move up and down;

a moving member, articulated to the guide rails;

a moving apparatus, which moves the moving member along the pair of guide rails; and anchoring members, which are interconnected with the moving member, to anchor the moving member to the supporting frame.

2. An apparatus for mounting and removing a supporting frame of a quilt in sewing machines comprising:

a pair of left and right guide rails of which one end has a first pivot on one side of a sewing machine, allowing circular movement using the first pivot as a fulcrum, the guide rails being arranged parallel to each other;

a pair of left and right supporting rails wherein one end has a second pivot on one side of the sewing machine, allowing for circular movement using the second pivot as a fulcrum, the supporting rails being arranged in parallel with the guide rails, and sliding to support the supporting frame of a quilt;

an apparatus for moving up and down to move the guide rails and the supporting rails in a circular manner using the first and second pivots as a fulcrum, and causing the guide rails and a second end of the supporting rails to move up and down;

a moving member articulated along the pair of guide rails;

a moving apparatus for moving the moving member along the pair of guide rails; and anchoring members provided to anchor the moving member to the supporting frame.

* * * * *